US009421592B2

(12) United States Patent
Jeong et al.

(10) Patent No.: US 9,421,592 B2
(45) Date of Patent: Aug. 23, 2016

(54) ASYMMETRIC ROLLING DEVICE, ASYMMETRIC ROLLING METHOD AND ROLLED MATERIAL MANUFACTURED USING SAME

(75) Inventors: Hyo-Tae Jeong, Gangneung (KR); Byung-Hak Choe, Gangneung (KR)

(73) Assignee: GANGNEUNG-WONJU NATIONAL UNIVERSITY INDUSTRY ACADEMY COOPERATION GROUP, Gangneung (KR)

( * ) Notice: Subject to any disclaimer, the term of this patent is extended or adjusted under 35 U.S.C. 154(b) by 572 days.

(21) Appl. No.: 13/635,900

(22) PCT Filed: Mar. 15, 2011

(86) PCT No.: PCT/KR2011/001781

§ 371 (c)(1),
(2), (4) Date: Sep. 18, 2012

(87) PCT Pub. No.: WO2011/115402

PCT Pub. Date: Sep. 22, 2011

(65) Prior Publication Data

US 2013/0017118 A1 Jan. 17, 2013

(30) Foreign Application Priority Data

Mar. 18, 2010 (KR) ..... 10-2010-0024299

(51) Int. Cl.
*B21B 1/22* (2006.01)
*B21B 27/02* (2006.01)

(52) U.S. Cl.
CPC ..... *B21B 27/02* (2013.01); *B21B 1/22* (2013.01); *B21B 2265/24* (2013.01); *B21B 2267/065* (2013.01)

(58) Field of Classification Search
CPC ..... B21D 35/02; B21D 35/12; B21D 37/46; B21D 37/48; B21D 41/02; B21D 41/06; B21D 2275/02; B21D 2275/04; B21D 2275/06; B21B 35/02; B21B 35/12; B21B 37/46; B21B 37/48; B21B 41/02; B21B 41/06; B21B 2275/02; B21B 2275/04; B21B 2275/06; B21B 1/22; B21B 1/227; B21B 3/00; B21B 2265/24; B21B 2267/065
USPC ..... 72/199, 234, 240, 249
See application file for complete search history.

(56) References Cited

U.S. PATENT DOCUMENTS 1,898,061 A * 2/1933 Otte ..... 148/111
2,219,665 A * 10/1940 Simons ..... 72/205

(Continued)

FOREIGN PATENT DOCUMENTS

JP 53-133555 A * 11/1978 ..... B21B 1/22
JP 54-110952 A 8/1979

(Continued)

OTHER PUBLICATIONS

"Texture and microstructure changes in asymmetrically hot rolled AZ31 magnesium alloy sheets", Su-Hyeon Kim et al. published, Aug. 2005.*

(Continued)

*Primary Examiner* — Edward Tolan

(57) ABSTRACT

An asymmetric rolling method for rolling a rolling material by using at least one pair of working rolls comprises rolls rotating at the same linear velocity and having different diameters. An asymmetric rolling apparatus may comprise a first roll contacting a first surface of a rolling material, a second roll having a diameter different from that of the first roll and contacting a second surface of the rolling material opposite to the first surface, and a power providing unit for providing power to each of the first and second rolls to adjust a ratio between angular velocities of the first and second rolls.

14 Claims, 13 Drawing Sheets

(56) References Cited

U.S. PATENT DOCUMENTS

| | | | | | |
|---|---|---|---|---|---|
| 4,269,055 | A * | 5/1981 | Sivachenko et al. | 72/180 |
| 4,299,103 | A * | 11/1981 | Marten | 72/11.8 |
| 4,406,715 | A * | 9/1983 | Nakayama et al. | 148/111 |
| 4,566,299 | A * | 1/1986 | Koyama et al. | 72/10.2 |
| 4,625,536 | A * | 12/1986 | Morooka | 72/249 |
| 4,781,050 | A * | 11/1988 | Winter et al. | 72/205 |
| 4,903,518 | A * | 2/1990 | Kimura et al. | 72/249 |
| 7,546,756 | B2 * | 6/2009 | Van Der Winden | 72/250 |
| 8,250,895 | B2 * | 8/2012 | Bozkaya | B21B 1/227 72/227 |
| 2005/0034500 | A1 | 2/2005 | Van Der Winden et al. | |
| 2005/0172691 | A1 * | 8/2005 | Mondiere | 72/164 |

FOREIGN PATENT DOCUMENTS

| | | | | |
|---|---|---|---|---|
| JP | 54-149351 | * | 11/1979 | B21B 1/22 |
| JP | 55-50905 A | * | 4/1980 | B21B 1/36 |
| JP | 56-158205 A | * | 5/1981 | B21B 1/22 |
| JP | 58-043808 U | | 3/1983 | |
| JP | 59-127912 | * | 7/1984 | B21B 35/00 |
| JP | 60-003903 A | | 1/1985 | |
| JP | 60-108108 A | | 6/1985 | |
| JP | 10-296303 A | | 11/1998 | |
| JP | 2004-306046 A | | 11/2004 | |
| JP | 2004-311110 A | | 11/2004 | |
| JP | 2005-500164 A | | 1/2005 | |
| JP | 2005-298885 A | | 10/2005 | |
| KR | 10-0718071 B1 | | 5/2007 | |
| KR | 10-0775242 B1 | | 11/2007 | |
| WO | WO 2008/105453 A1 | | 9/2008 | |
| WO | WO 2009/103436 A1 | | 8/2009 | |

OTHER PUBLICATIONS

International Search Report for PCT/KR2011/001781 filed on Mar. 15, 2011.

* cited by examiner (a)

(b)

ASYMMETRIC ROLLING DEVICE, ASYMMETRIC ROLLING METHOD AND ROLLED MATERIAL MANUFACTURED USING SAME

TECHNICAL FIELD

The present invention relates to a rolling technology used to form a metal into a rolled material, and more particularly, to a rolling technology for improving formability or other physical properties of a rolled material by controlling texture of the rolled material.

BACKGROUND ART

In general, rolling is performed to process a metal into a sheet having a certain size. When rolling is performed, the volume of a rolling material changes and thus microstructures of the rolling material also change. When microstructures of a rolling material change, the rolling material has texture in which crystals are oriented in a particular direction. Texture formed due to rolling is closely related to formability of a rolling material. Accordingly, by controlling texture of a rolling material in a rolling process, formability of the rolling material after being rolled may be improved.

DETAILED DESCRIPTION OF THE INVENTION

Technical Problem

The present invention provides a rolling method capable of providing a high formability to a rolled material by controlling texture of the rolled material.

The present invention also provides a rolled material having a formability improved by performing the rolling method.

The present invention also provides a rolling apparatus for performing the rolling method.

Additional aspects and/or advantages of the invention will be set forth in part in the description which follows and, in part, will be apparent from the description, or may be learned by practice of the invention.

Technical Solution

According to an aspect of the present invention, there is provided an asymmetric rolling method including disposing a rolling material having first and second surfaces between a first roll and a second roll having a diameter greater than that of the first roll; and rolling the rolling material by adjusting power provided from a power providing unit to each of the first and second rolls to control angular velocities of the first and second rolls to be different from each other such that a shear strain applied by the first roll to one of the first and second surfaces of the rolling material is different from that applied by the second roll to the other of the first and second surfaces.

The rolling material may be rolled by maintaining linear velocities of the first and second rolls to be the same.

A linear velocity difference between the first and second rolls, which is defined by Equation 1, may be equal to or less than 10%.

$$\frac{|\upsilon_1 - \upsilon_2|}{\upsilon_2} \quad \text{[Equation 1]}$$

$\upsilon_1$: a linear velocity of the first roll $\upsilon_2$: a linear velocity of the second roll The rolling material may be rolled two or more times by allowing the first roll to apply a shear strain to the first surface and allowing the second roll to apply a shear strain to the second surface.

The rolling material may be rolled two or more times by switching surfaces of the rolling material, which receive shear strains from the first and second rolls, at least once.

The rolling material may be rolled two or more times in the same rolling direction.

The rolling material may be rolled two or more times by changing rolling directions of the rolling material at least once.

A third roll having a diameter greater than that of the first roll may be coupled to the first roll to support the first roll at a side opposite to the second roll.

According to another aspect of the present invention, there is provided an asymmetric rolling method for rolling a rolling material by using at least one pair of working rolls with different diameters and controlled to rotate at the same linear velocity by power provided by a power providing unit.

An asymmetric rolling method may be performed a plurality of times, and the plurality of times may include turning the rolling material upside down at least once between passes.

An asymmetric rolling method may be performed a plurality of times, and the plurality of times may include changing rolling directions of the rolling material at least once between passes.

A backup roll for supporting one of the working rolls, which has a relatively small diameter, may be coupled to the one of the working rolls at a side opposite to the other of the working rolls, which has a relatively large diameter.

According to another aspect of the present invention, there is provided a rolled material manufactured by using the above asymmetric rolling method.

The rolled material may have a hexagonal close-packed (HCP) crystal structure. Also, the rolled material may include magnesium (Mg), an Mg alloy, titanium (Ti), or a Ti alloy. Alternatively, the rolled material may include aluminum (Al), an Al alloy, or an iron-silicon (Fe—Si) alloy.

According to another aspect of the present invention, there is provided an asymmetric rolling apparatus including a first roll contacting a first surface of a rolling material; a second roll having a diameter different from that of the first roll and contacting a second surface of the rolling material opposite to the first surface; and a power providing unit for providing power to each of the first and second rolls so as to adjust linear velocities of the first and second rolls to be the same.

The power providing unit may control linear velocities of the first and second rolls to be the same.

The power providing unit may include first and second motors for respectively driving the first and second rolls; and a motor control unit for controlling angular velocities of the first and second motors.

The asymmetric rolling apparatus may further include a first gear coupled to the first roll and a second gear coupled to the second roll, wherein the second gear is coupled to the first gear with a gear ratio different from that of the first gear, and the power providing unit may include a motor for providing driving power to the first or second gear.

The asymmetric rolling apparatus may further include a third roll having a diameter greater than that of the first roll and coupled to the first roll to support the first roll at a side opposite to the second roll.

The power providing unit may include a first motor for driving the first or third roll, a second motor for driving the second roll, and a motor control unit for controlling angular velocities of the first and second motors.

The asymmetric rolling apparatus may further include a first gear coupled to the first or third roll and a second gear coupled to the second roll, wherein the second gear is coupled to the first gear with a gear ratio different from that of the first gear, and the power providing unit may include a motor for providing driving power to the first or second gear.

The first or second gear may be a variable gear for changing at least one gear ratio, and the asymmetric rolling apparatus may further include a gear control unit for controlling the gear ratio.

Advantageous Effects

A rolling method and apparatus according to embodiments of the present invention may produce rolled material with improved formability compared to conventional systems. In particular, if a metallic material having a poor formability at room temperature such as a magnesium (Mg) alloy is rolled according to an embodiment of the present invention, slip systems may be oriented in such a way that shear strains are easily received even at room temperature. Thus, an excellent formability at room temperature may be achieved.

The effects of the present invention are not limited to the above-mentioned advantages, and may be applied to all materials of which formability is improvable through rolling. Additional effects of the present invention will be apparent to one of ordinary skill in the art from the following description.

BEST MODE

Figure 1:
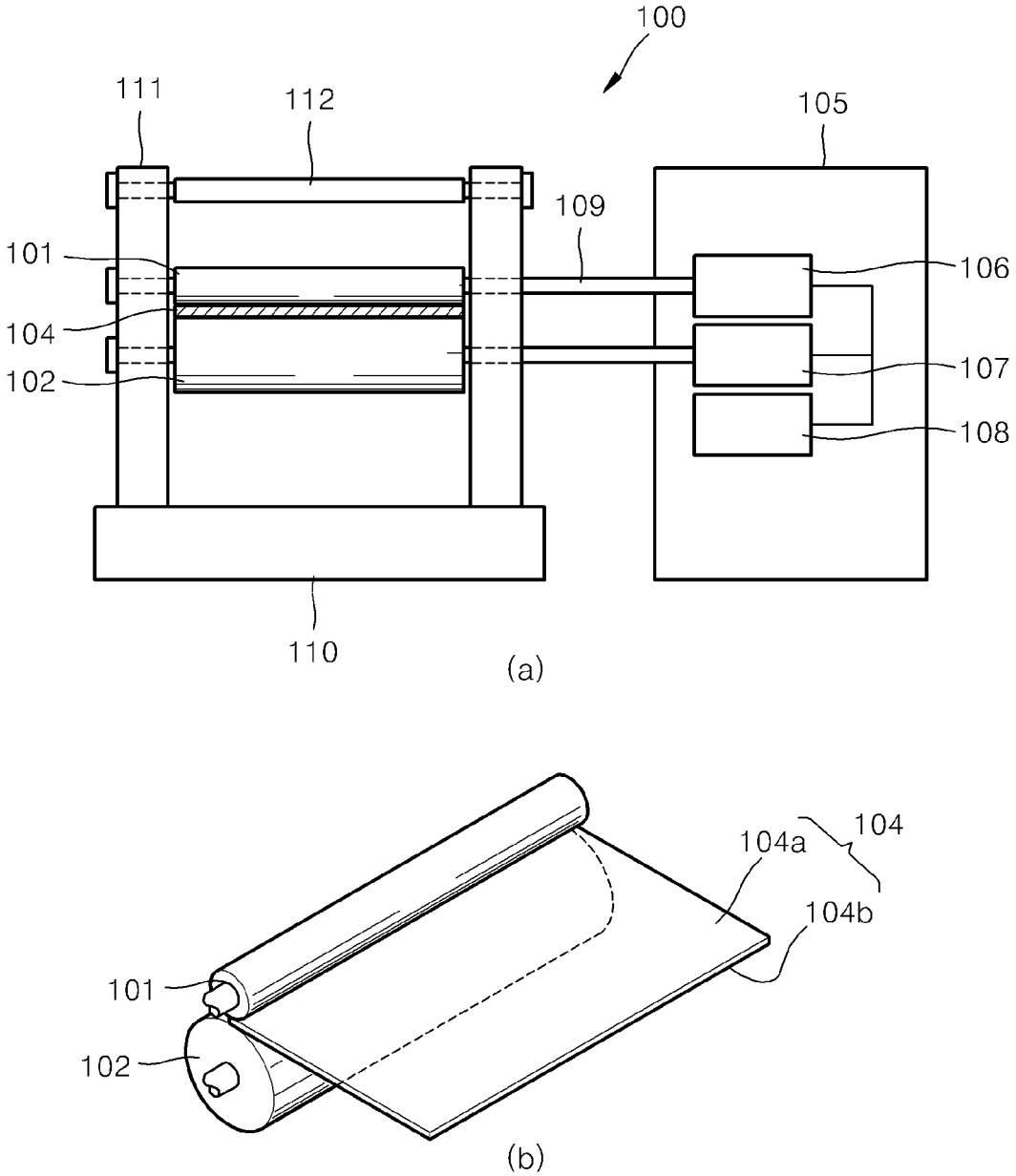
FIGS. 1A and 1B are a front view of and a perspective view of a rolling apparatus according to an embodiment of the present invention.

Hereinafter, the present invention will be described in detail by explaining embodiments of the invention with reference to the attached drawings. In the following description of the present invention, a detailed description of known functions and configurations incorporated herein will be omitted when it may make the subject matter of the present invention unclear.

A rolling apparatus and a rolling method, according to embodiments of the present invention, may be applied to any rolling material in order to improve formability of the rolling material, and the following embodiments exemplarily show the concept of the present invention.

The invention may, however, be embodied in many different forms and should not be construed as being limited to the embodiments set forth herein; rather, these embodiments are provided so that this disclosure will be thorough and complete, and will fully convey the concept of the invention to one of ordinary skill in the art. In the drawings, the sizes of elements may be exaggerated for convenience of explanation.

In the following description, the term "texture" may refer to the crystalline orientation of a polycrystalline material. The term "texture" does not limit the scope of the present invention. The texture of a material is used as a relative concept rather than an absolute concept. That is, if a material has texture in a predetermined direction, it means that most, not all, of crystalline grains of the material have texture in the mentioned direction.

A pole figure may be a figure showing a distribution of the direction of crystallographic lattice planes in the form of stereographic projection to show the orientation or texture of crystals of a material. The pole figure may be created by using X-ray diffraction (XRD).

Furthermore, as used herein, a rolling material refers to a target material to be rolled, and a rolled material refers to a resultant material obtained by rolling the rolling material.

FIGS. 1A and 1B illustrate a rolling apparatus 100 according to an embodiment of the present invention. In more detail, FIG. 1A is a front view of the rolling apparatus 100, and FIG. 1B is a perspective view of first and second rolls 101 and 102, and a rolling material 104 of the rolling apparatus 100 illustrated in FIG. 1A. As illustrated in FIGS. 1A and 1B, the rolling apparatus 100 is an asymmetric rolling apparatus in which the first and second rolls 101 and 102 have different diameters. The exemplary rolling apparatus 100 includes the first roll 101 contacting a first surface 104*a* of the rolling material 104, the second roll 102 having a diameter greater than that of the first roll 101 and contacting a second surface 104*b* of the rolling material 104 opposite to the first surface 104*a*, and a power providing unit 105 for providing power to each of the first and second rolls 101 and 102 to separately adjust angular velocities of the first and second rolls 101 and 102.

Although, as working rolls, the first and second rolls 101 and 102 are oriented as upper and lower rolls in the embodiment shown in FIGS. 1A and 1B, other embodiments are also available. Also, for convenience of explanation, a surface contacting the first roll 101 that is the upper roll is shown as the first surface 104*a*, and a surface contacting the second roll 102 that is the lower roll is shown as the second surface 104*b*. Accordingly, if the rolling material 104 is turned upside down, the first roll 101 contacts the second surface 104*b* of the rolling material 104, and the second roll 102 contacts the first surface 104*a* of the rolling material 104.

The first and second rolls 101 and 102 are oriented in parallel and are spaced apart from a supporting plate 110, and are mounted between frames 111 fixed by a coupling member 112 such as a screw.

In an embodiment, as illustrated in FIG. 1A, the power providing unit 105 may include first and second motors 106 and 107 for respectively driving the first and second rolls 101 and 102, and a motor control unit 108 for controlling angular velocities of the first and second motors 106 and 107.

In this embodiment, the first and second motors 106 and 107 transfer rotatory power to the first and second rolls 101 and 102 via connection members 109.

The motor control unit 108 may control the angular velocities of the first and second rolls 101 and 102 connected to or coupled to the first and second motors 106 and 107 by controlling the angular velocities of the first and second motors 106 and 107, and thus may control linear velocities of the first and second rolls 101 and 102. The relationship between angular velocity and linear velocity can be represented by multiplying angular velocities of the first and second rolls 101 and 102 by radiuses of the first and second rolls 101 and 102.

By controlling the linear velocities of the first and second rolls 101 and 102 as described above, a first shear strain applied by the first roll 101 to the first surface 104*a* of the rolling material 104 may be controlled to be different from a second shear strain applied by the second roll 102 to the second surface 104*b* of the rolling material 104.

For example, the motor control unit 108 may control the first and second rolls 101 and 102 to roll the rolling material 104 by rotating the first and second rolls 101 and 102 to have the same linear velocity. That is, the linear velocities of the first and second rolls 101 and 102 may be the same by controlling a ratio between the angular velocities of the first and second rolls 101 and 102 to be the same as the inverse of the ratio between the radiuses of the first and second rolls 101 and 102. Although linear velocities have been described as being the same, the term "the same" should be regarded as substantial sameness including complete sameness and sameness within a process margin caused by an error that occurs due to process variations even when a user controls signals of the motor control unit 108 with an intention of controlling the angular velocities of the first and second rolls 101 and 102 to be the same. The "sameness" between the linear velocities of the first and second rolls 101 and 102 is also applied to the following descriptions.

Meanwhile, according to another embodiment of the present invention, as illustrated in FIGS. 2A and 2B, a third roll 103 having a diameter greater than that of the first roll 101, and coupled to the first roll 101 to support the first roll 101 at a side opposite to the second roll 102 may be further included. In an embodiment, the first and second rolls 101 and 102 may function as working rolls that contact and directly apply shear strains to the first and second surfaces 104*a* and 104*b* of the rolling material 104, and the third roll 103 may function as a backup roll that helps the first roll 101 to be balanced against an external force applied in a rolling process from the second roll 102 having a diameter greater than that of the first roll 101.

A power providing unit 105 may include the first motor 106 for driving the first or third roll 101 or 103, the second motor 107 for driving the second roll 102, and the motor control unit 108 for controlling the angular velocities of the first and second motors 106 and 107.

For example, as illustrated in FIG. 2A, the first motor 106 is coupled to the third roll 103 and transfers driving power to the third roll 103. If the third roll 103 rotates, the first roll 101 contacting the third roll 103 may also rotate due to friction. Although not shown in FIGS. 2A and 2B, the first motor 106 may be connected to or coupled to the first roll 101 to allow the first roll 101 to rotate, and the third roll 103 may rotate due to friction according to the above-described principle.

Meanwhile, according to another embodiment of the present invention, power provided by the power providing unit 105 may be transferred to the working rolls via gears. For example, as illustrated in FIG. 3, the rolling apparatus 100 including the first through third rolls 101 through 103 may include a first gear 114 coupled to the first or third roll 101 or 103, and a second gear 115 coupled to the second roll 102, wherein the second gear 115 is coupled to the first gear 114 with a predetermined gear ratio, and the power providing unit 105 may include a motor 113 for transferring driving power to the first or second gear 114 or 115.

Figure 3:
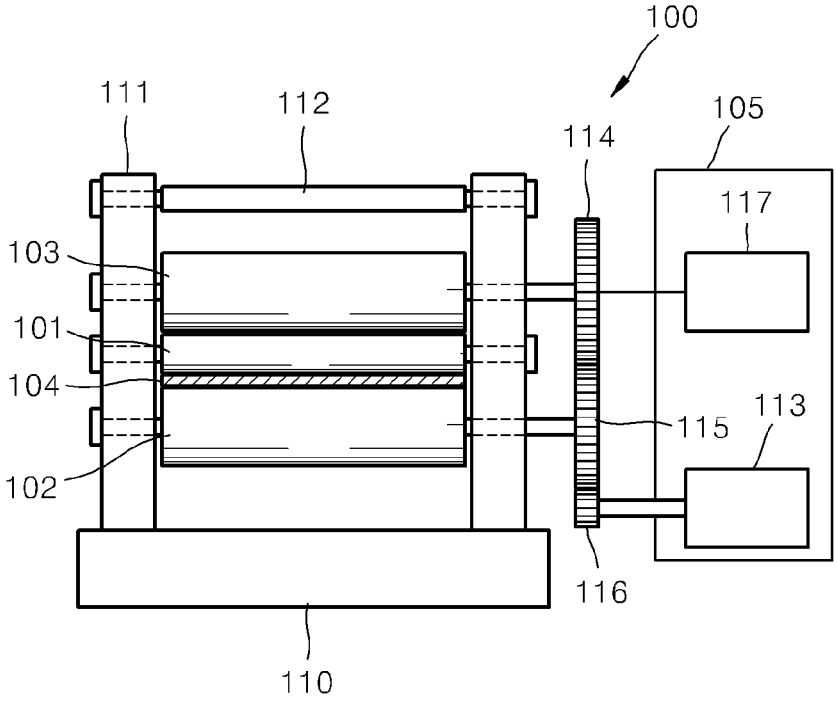
FIG. 3 is a front view of a rolling apparatus according to another embodiment of the present invention.

Although power of the motor 113 may be transferred to the second gear 115 via a driving gear 116 as shown in FIG. 3, embodiments of a rolling apparatus 100 are not limited thereto, and a motor 113 may be directly connected to and may directly transfer power to the first or second gear 114 or 115 without using the driving gear 116.

Also, although the embodiment of the rolling apparatus 100 shown in FIG. 3 includes the third roll 103 as a support roll, in embodiments where only the first and second rolls 101 and 102 are included without including the third roll 103, the first and second gears 114 and 115 may be respectively connected to the first and second rolls 101 and 102 as described above.

Meanwhile, the first or second gear 114 or 115 may be a geared for variably changing at least one gear ratio, and a gear control unit 117 coupled to the first or second gear 114 or 115 which may be configured for controlling the gear ratio may be further included.

In an embodiment of the rolling apparatus 100, the linear velocities of the first and second rolls 101 and 102 may be controlled by adjusting the gear ratios of the first and second gears 114 and 115 in consideration of the diameters of the first and second rolls 101 and 102. For example, power generated by the motor 113 may be transferred so that the first and second rolls 101 and 102 have the same linear velocity according to the gear configurations described above. Also, if the first and second gears 114 and 115 are variable gears, the gear ratios of the first and second gears 114 and 115 may be variably controlled by using the gear control unit 117 in consideration of the diameter of the first or second roll 101 or 102, and thus the linear velocities of the first and second rolls 101 and 102 may be controlled to be the same.

Meanwhile, although the first and second rolls 101 and 102 having different diameters form a pair of working rolls in FIGS. 1 and 3, the present invention is not limited thereto, and a plurality of pairs of working rolls may be formed adjacent to each other. Accordingly, a rolling method according to an embodiment of the present invention may include rolling a rolling material by using at least one pair of working rolls including rolling rolls having different diameters.

The rolling material 104 to be rolled by the above-described asymmetric rolling apparatus 100 may include magnesium (Mg) or a Mg alloy having a hexagonal close-packed (HCP) crystal structure. Research is being currently conducted on Mg as a next-generation lightweight material. Mg, which typically has a density of 1.74 g/cm$^3$ has a low weight and excellent specific strength and specific modulus in comparison to iron (Fe) which typically has a density of 7.90 g/cm$^3$ or aluminum (Al) which typically a density of 2.7 g/cm$^3$. Also, due to high absorption of vibration, impact, electromagnetic waves, etc. and excellent electric and thermal conductivities, Mg is used as a lightweight material in motor vehicles, aircraft, etc. and is also used in electronic fields of mobile phones, laptop computers, etc.

Figure 4:
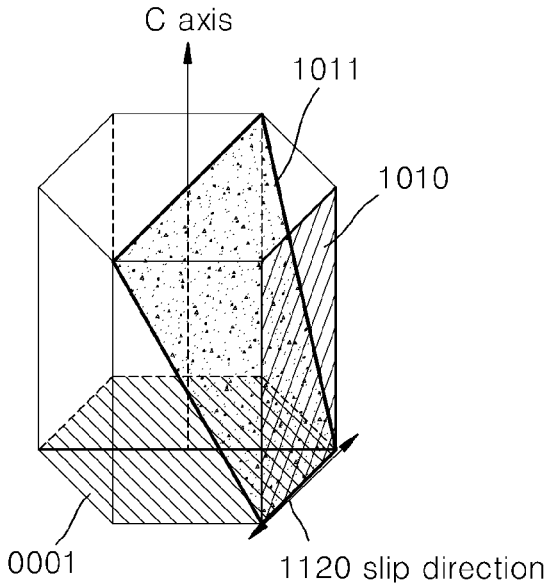
FIG. 4 shows slip systems of magnesium (Mg) having a hexagonal close-packed (HCP) crystal structure.

However, Mg having a HCP crystal structure has poor slip systems and thus has a low formability at room temperature. That is, as illustrated in FIG. 4, during formation, a basal plane slip system of {0001}<1120>, a prismatic slip system of {1010}<1120>, a pyramidal slip system of {1011}<1120>, etc. are mainly used as deformation mechanisms of Mg. However, since critical resolved shear stress values of the basal plane slip system are substantially lower than values for other mechanisms at room temperature, the orientation of the basal plane slip system within the rolling material has a great influence on room temperature formability.

Figure 5:
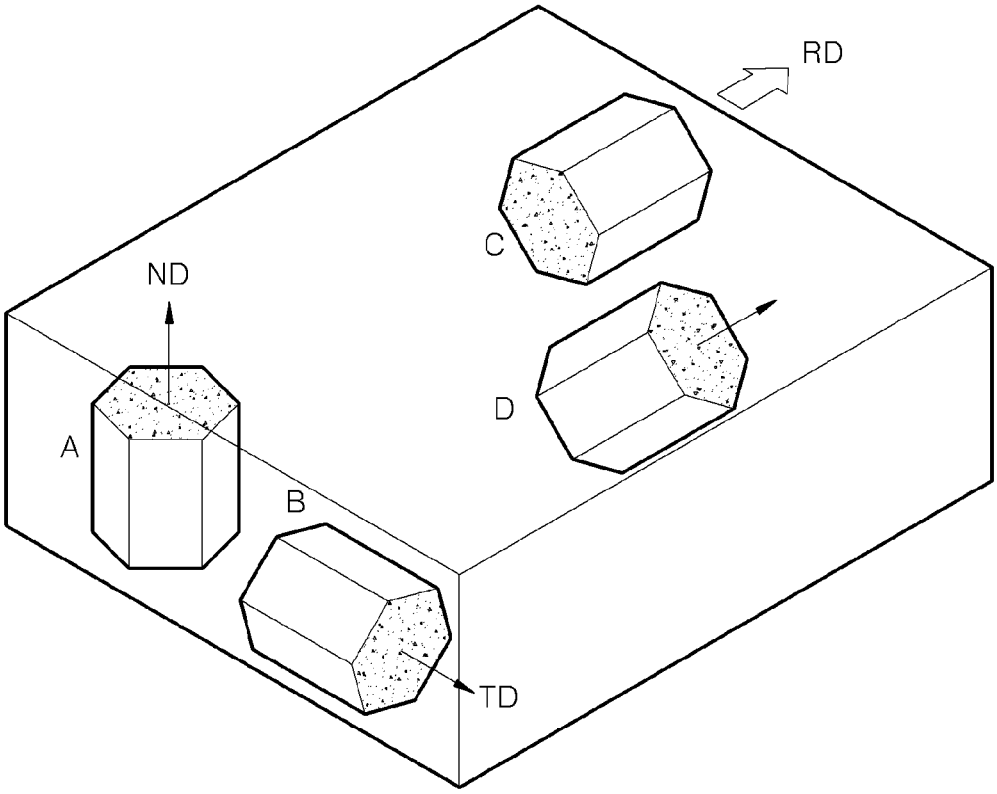
FIG. 5 shows orientations of HCP crystals of a rolling material.

When the basal plane slip system is parallel to rolling surfaces of the rolling material 104, i.e., perpendicular to a normal direction ND, as represented by crystal A in FIG. 5, when the basal plane slip system is perpendicular to a transverse direction TD as represented by crystal B in FIG. 5, or when the basal plane slip system is perpendicular to a rolling direction RD as represented by crystal C in FIG. 5, formability at room temperature is poor. This is because, when rolled Mg is formed, if a main deformation direction (i.e., ND, RD, or TD in FIG. 5) is perpendicular or parallel to the basal plane slip system, the orientation of the basal slip plane is not configured to facilitate deformation caused by the forming process.

However, if the basal plane slip system is tilted by a certain angle with respect to a main deformation direction as represented by crystal D in FIG. 5, the basal slip plane is oriented to facilitate deformation, and an excellent formability at room temperature is achieved.

Figure 6:
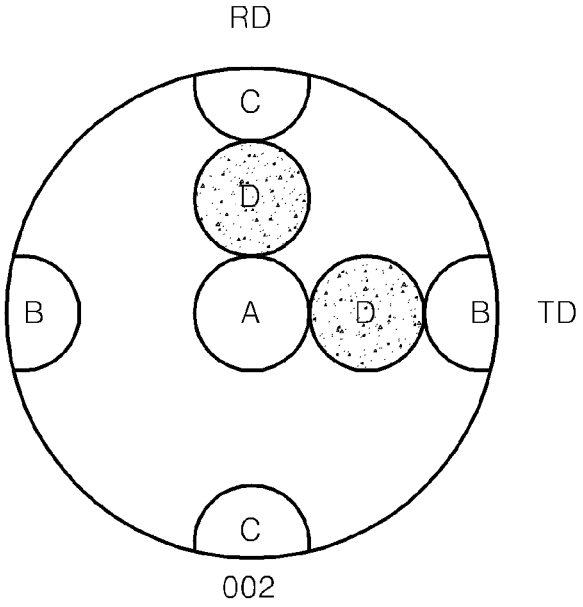
FIG. 6 shows poles of crystals A, B, C, and D illustrated in FIG. 5, on the (0001) pole figure.

The orientation and distribution of the basal plane slip systems in a material may be characterized as illustrated in the (0001) pole figure of FIG. 6. FIG. 6 shows how poles of the crystals A, B, C, and D illustrated in FIG. 5 would appear on an (0001) pole figure.

Figure 2:
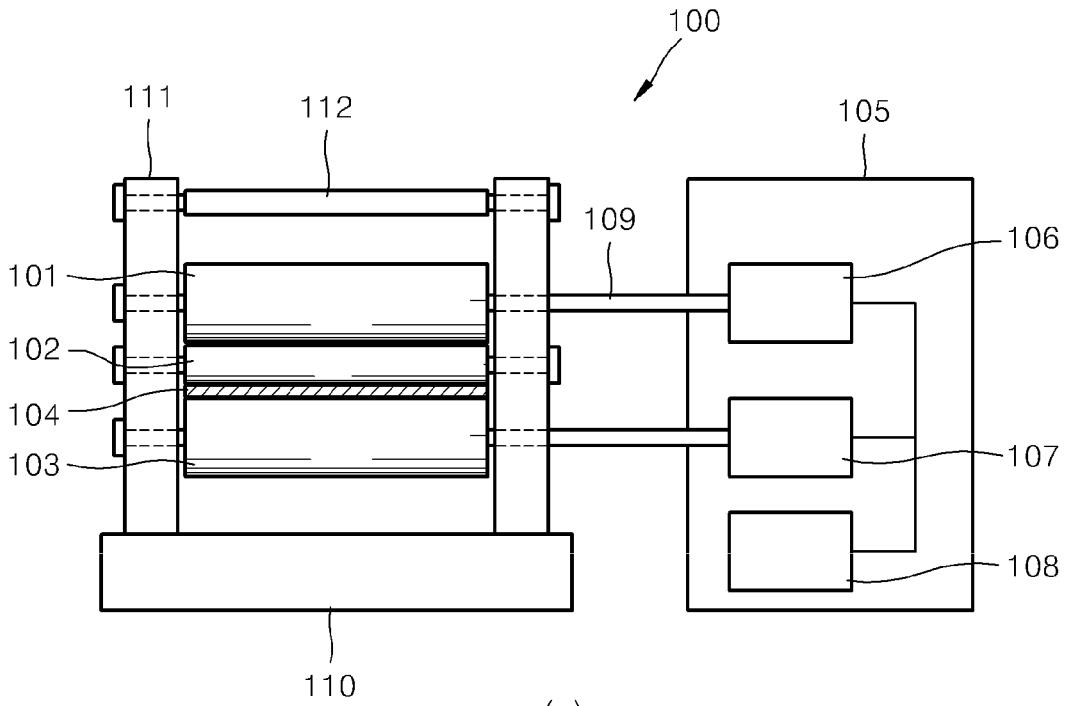
FIGS. 2A and 2B are a front view of and a perspective view of a rolling apparatus according to another embodiment of the present invention.
Figure 2:
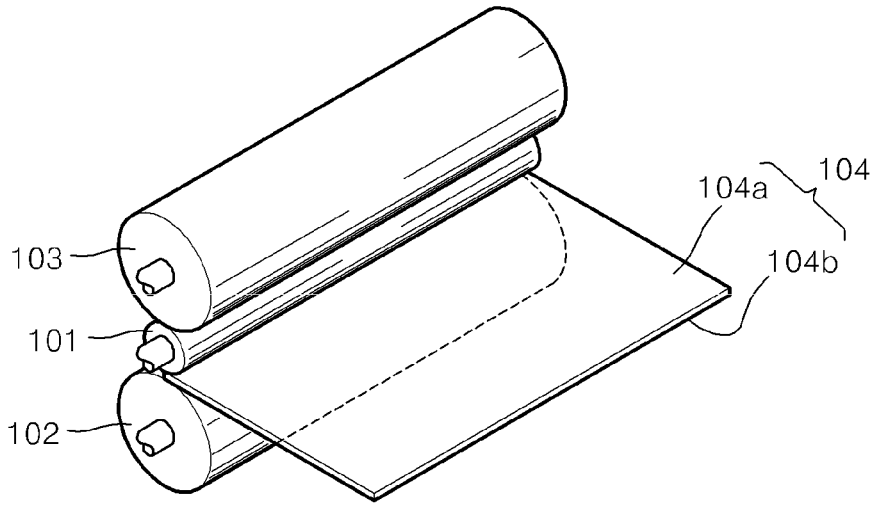

If a rolling process is performed by using the asymmetric rolling apparatus 100 illustrated in FIGS. 1 through 3, crystals of Mg or an Mg alloy may have an orientation that is advantageous for formability. In more detail, an asymmetric rolling method according to an embodiment of the present invention may include disposing the rolling material 104 having the first and second surfaces 104*a* and 104*b* between the first and second rolls 101 and 102, and rolling the rolling material 104 by adjusting angular velocities of the first and second rolls 101 and 102 to be different from each other such that a shear strain applied by the first roll 101 to one of the first and second surfaces 104*a* and 104*b* of the rolling material 104, for example, the first surface 104*a*, is different from that applied by the second roll 102 to the other of the first and second surfaces 104*a* and 104*b*, for example, the second surface 104*b*.

In this case, the rolling material 104 may be rolled by maintaining, for example, linear velocities of the first and second rolls 101 and 102 to be the same.

The rolling material 104 may include an AZ31 alloy as an Mg alloy. Although embodiments are not limited thereto, in the following description, the rolling material 104 is assumed as an AZ31 alloy.

Meanwhile, an asymmetric rolling method according to an embodiment of the present invention includes a method of rolling the rolling material a plurality of times. The above rolling method may be used to prevent a problem caused when a large reduction ratio is applied to a rolling material, by repeatedly applying appropriately predetermined reduction ratios to the rolling material.

In an embodiment, the plurality of times refers to a total number of times that a rolling material is rolled by working rolls. In embodiments, a rolling material may be rolled a plurality of times by reinserting the material through the same set of working rolls, or by inserting the rolling material into a plurality of pairs of working rolls arranged in series in a continuous process. Embodiments of the present invention include continuous insertion and intermittent insertion of the rolling material between the working rolls.

A method of rolling a plurality of times may include reinsertion of the rolling material after being physically released from the working rolls, and reinsertion of the rolling material between the working rolls by allowing the working rolls to rotate in reverse while the rolling material is still disposed between the working rolls.

In some cases, each of the plurality of times that rolling is performed may be referred to as a "pass".

Figure 7:
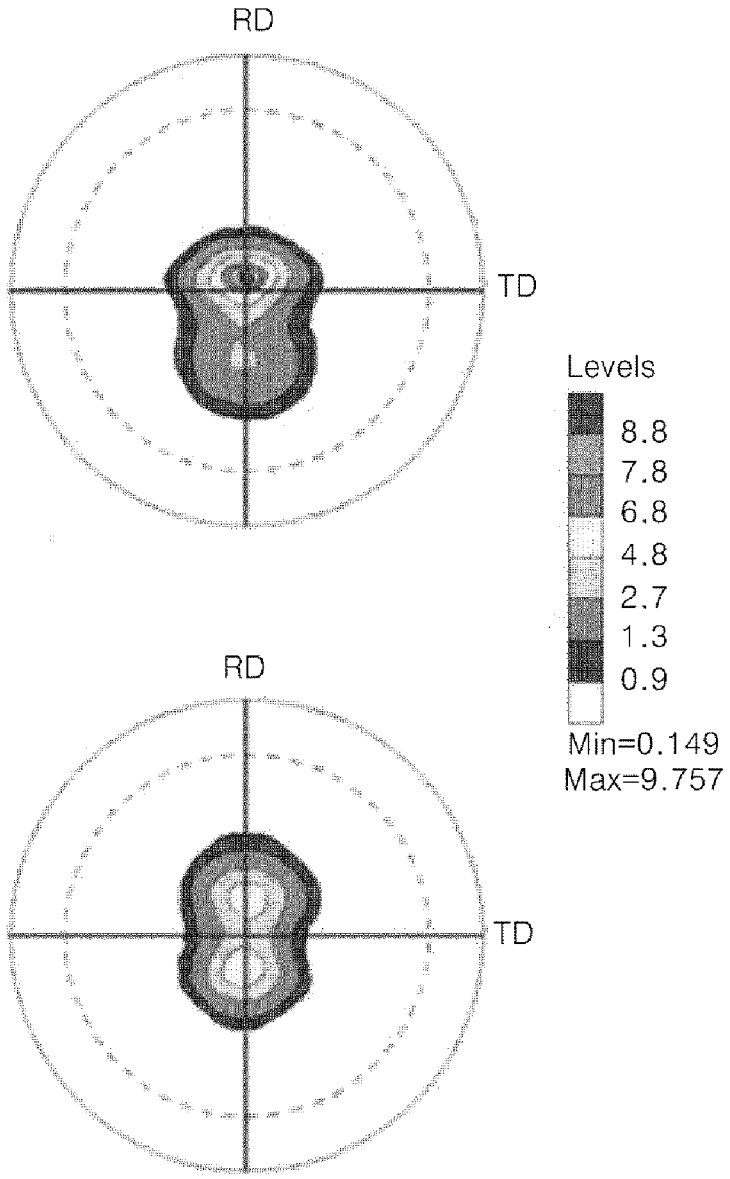
FIG. 7 shows the (0001) pole figures of an AZ31 alloy rolled by using a rolling method according to an embodiment of the present invention.

FIG. 7 shows the (0001) pole figures of an AZ31 alloy rolled five times by using the rolling apparatus 100 illustrated in FIGS. 2A and 2B and by controlling the first and second rolls 101 and 102 to have the same linear velocity. In this case, a reduction ratio of the AZ31 alloy was 75%, and a rolling temperature was 300° C. Rolling was performed in the same rolling direction by allowing the first and second surfaces 104*a* and 104*b* of the rolling material 104, i.e., the AZ31 alloy, to respectively contact and receive shear strains from the first and second rolls 101 and 102. In FIG. 7, a lower figure is the (0001) pole figure of the first surface 104*a* that received a shear strain from is the first roll 101, and an upper figure is the (0001) pole figure of the second surface 104*b* that received a shear strain from the second roll 102.

As illustrated in FIG. 7, in an asymmetric rolling method according to an embodiment of the present invention, an orientation of a basal plane, i.e., the (0001) plane, of HCP crystal is out of center. In more detail, a rotation angle (i.e., an angle from the center) of a pole point of the basal plane with respect to the first surface 104*a* that received a shear strain from the first roll 101 was about 15°, and a rotation angle of a pole point of the basal plane with respect to the second surface 104*b* that received a shear strain from the second roll 102 was about 6°.

Figure 8:
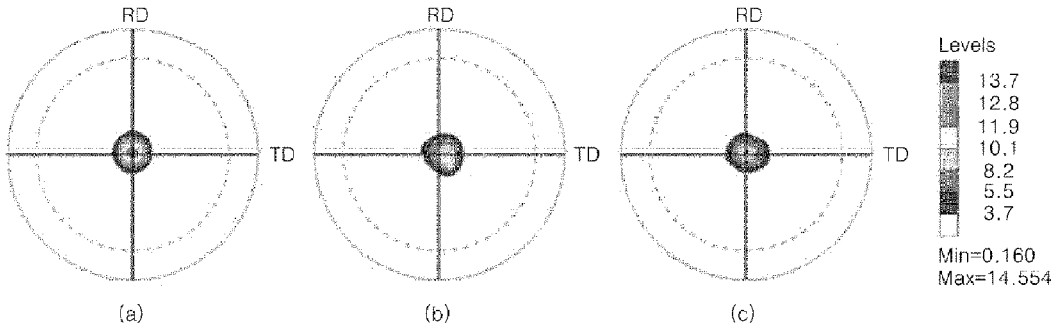
FIGS. 8 through 10 show the (0001) pole figures of an AZ31 alloy rolled by using rolling methods according to comparative examples.
Figure 9:
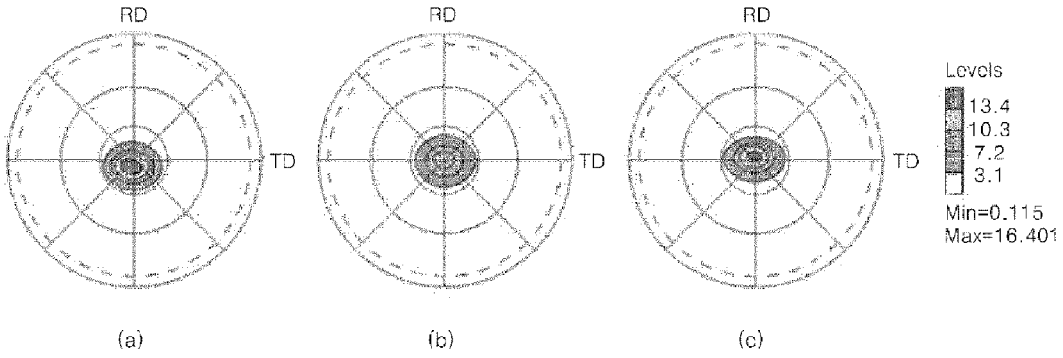
Figure 10:
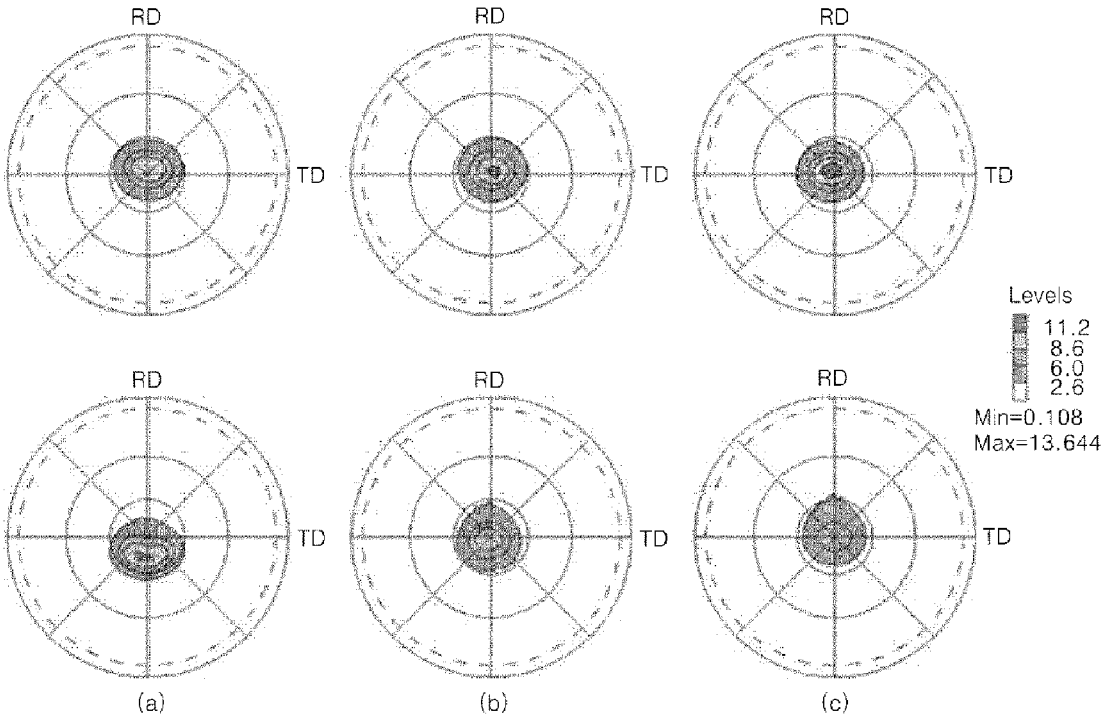

As comparative examples, FIGS. 8 through 10 show the (0001) pole figures of an AZ31 alloy rolled by using a conventional rolling apparatus including working rolls having the same diameter.

FIGS. 8A through 8C show the (0001) pole figures of the AZ31 alloy rolled a plural number of times to a reduction ratio of 75% at a rolling temperature of 300° C. by allowing first and second surfaces of a rolling material, i.e., the AZ31 alloy, to respectively contact and receive shear strains from first and second rolls. In more detail, FIG. 8A shows the (0001) pole figure obtained when rolling with a reduction ratio of 10% was performed twelve times, FIG. 8B shows the (0001) pole figure obtained when rolling with a reduction ratio of 20% was performed six times, and FIG. 8C shows the (0001) pole figure obtained when rolling with a reduction ratio of 30% was performed four times. As illustrated in FIGS. 8A through 8C, in all conditions, pole points have maximum polar strengths equal to greater than 10% and are all centered.

FIGS. 9A through 9C show the (0001) pole figures of the AZ31 alloy rolled at a rolling temperature of 200° C. In this case, reduction ratios were 50%, 30%, and 15% respectively.

As illustrated in FIGS. 9A through 9C, pole points of a basal plane have maximum polar strengths equal to greater than 12% and are all centered.

Based on the above results, if rolling is performed by using the conventional rolling apparatus including the first and second rolls having the same size, even when a reduction ratio or a rolling temperature is changed, the pole points of the basal plane are centered. Therefore, in comparison to an AZ31 alloy rolled using conventional rolling rolls having the same diameter, a texture of an AZ31 alloy rolled according to an embodiment of the present invention may have an orientation capable of greatly improving formability.

Meanwhile, FIGS. 10A through 10C show the (0001) pole figures of the AZ31 alloy rolled by using a conventional differential speed rolling method performed by rotating one of working rolls having the same diameter at a linear velocity greater than that of the other of the working rolls. In this case, a ratio between linear velocities of the working rolls was maintained as 3:1, a rolling temperature was 200° C., and reduction ratios were 70%, 30%, and 15% respectively in FIGS. 10A through 10C. In FIGS. 10A through 10C, lower figures are the (0001) pole figures of a surface that receives a shear strain from the fast roll, and upper figures are the (0001) pole figures of a surface that receives a shear strain from the slow roll.

If differential speed rolling is performed as described above, regardless of reduction ratios and a linear velocity difference between the two rolls, orientations of crystals are centered in comparison to the embodiments shown in FIG. 7, and a characteristic of having pole points of a basal plane out of center in the embodiment illustrated in FIG. 7, is not present in the pole figures of FIGS. 8 through 10.

As described above, in comparison to an AZ31 alloy rolled by using rolling rolls having the same diameter, an AZ31 alloy rolled by using an asymmetric rolling method according to an embodiment of the present invention may have an orientation of crystals on a basal plane which is capable of greatly improving formability.

In addition, if differential speed rolling is performed by using working rolls having the same diameter, since a rolling material slips due to a linear velocity difference between two rolls, shear strains may not be actually applied from rolling rolls to the rolling material. Also, the rolling material released out of the rolling rolls may be bent or may have rough surfaces.

However, if an asymmetric rolling method according to an embodiment of the present invention is used, since asymmetric shear strains due to different diameters of working rolls are applied using the same linear velocities, even though asymmetric rolling is performed, the rolling material may not slip. Also, defects such as bending or increased surface roughness of the rolling material, which occur in differential speed rolling, are not caused.

Meanwhile, if an asymmetric rolling method according to an embodiment of the present invention is used, angular velocities of the first and second rolls 101 and 102 may be controlled with in a range in which a linear velocity difference defined by Equation 1 is equal to or less than 10%.

$$\frac{|\upsilon_1 - \upsilon_2|}{\upsilon_2} \quad \text{[Equation 1]}$$

$\upsilon_1$: a linear velocity of the first roll 101

$\upsilon_2$: a linear velocity of the second roll 102

In an embodiment, if the linear velocity difference between the first and second rolls 101 and 102 having different diameters, which is defined by Equation 1, is greater than 10%, the rolling material released from the two rolling rolls may be bent due to, for example, an imbalance in stress.

Another embodiment of an asymmetric rolling method performed a plurality of times includes switching surfaces of the rolling material 104, which receive shear strains from the first and second rolls 101 and 102, at least once between passes.

Figure 11:
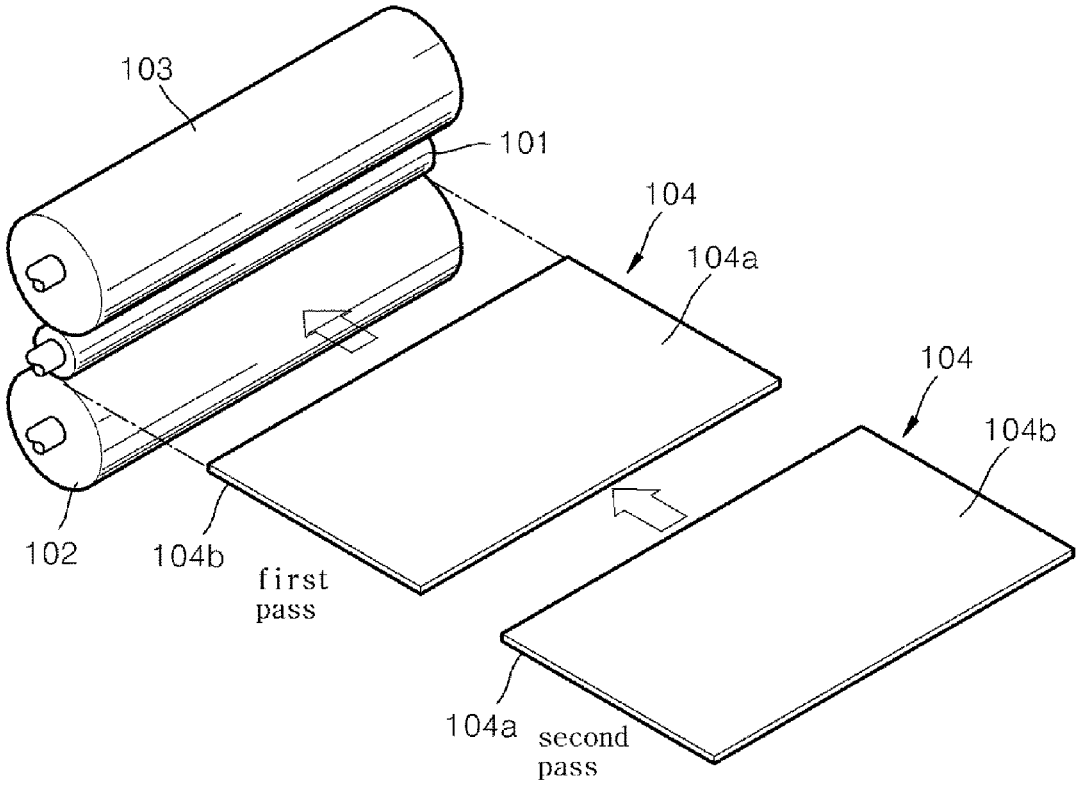
FIG. 11 is a diagram for describing a rolling method according to another embodiment of the present invention.

For example, in an embodiment illustrated in FIG. 11, the rolling material 104 is rolled in a first pass where the first and second surfaces 104*a* and 104*b* of the rolling material 104 to contact the first and second rolls 101 and 102 respectively. Subsequently, the rolling material 104 is turned upside down and is rolled in a second pass where the first and second surfaces 104*a* and 104*b* of the rolling material 104 contact the second and first rolls 102 and 101, respectively. In other words, in an embodiment, upper and lower surfaces of rolling material 104 may be inverted in separate passes of a plurality of passes performed on the same rolling material.

In an embodiment, two or more passes may be performed between the same pair of rolling rolls in a batch process, or may be performed between different pairs of rolling rolls corresponding to the passes.

Figure 12:
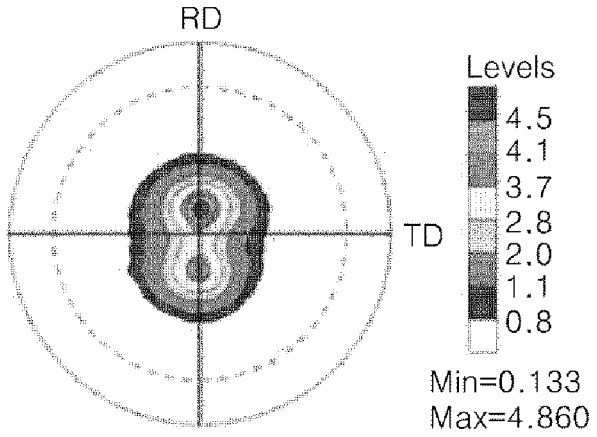
FIG. 12 shows the (0001) pole figure of an AZ31 alloy rolled by using the rolling method illustrated in FIG. 11.

Thus, the asymmetric shear strains due to different diameters of the first and second rolls 101 and 102 may be alternately applied to the first and second surfaces 104*a* and 104*b*, so that shear strains applied to each surface in the first and second passes may be normalized to a certain degree. The number of times that rolling is performed may be two or more according to a desired reduction ratio. Embodiments of the present invention are not limited by the particular number of times that the first and second surfaces 104*a* and 104*b* of the rolling material 104 are switched, or the number or order of passes that may be performed between switching FIG. 12 shows an (0001) pole figure of an AZ31 alloy rolled at a rolling temperature of 300° C. in a total of five passes by switching rolling surfaces between each pass (a rolling reduction ratio was 75%). A rotation angle of a basal plane is about 17°, which is greater than those of the (0001) pole figures illustrated in FIGS. 8 through 10.

Meanwhile, a rolling method according to another embodiment of the present invention includes rolling a plurality of times while changing rolling directions between passes.

Figure 13:
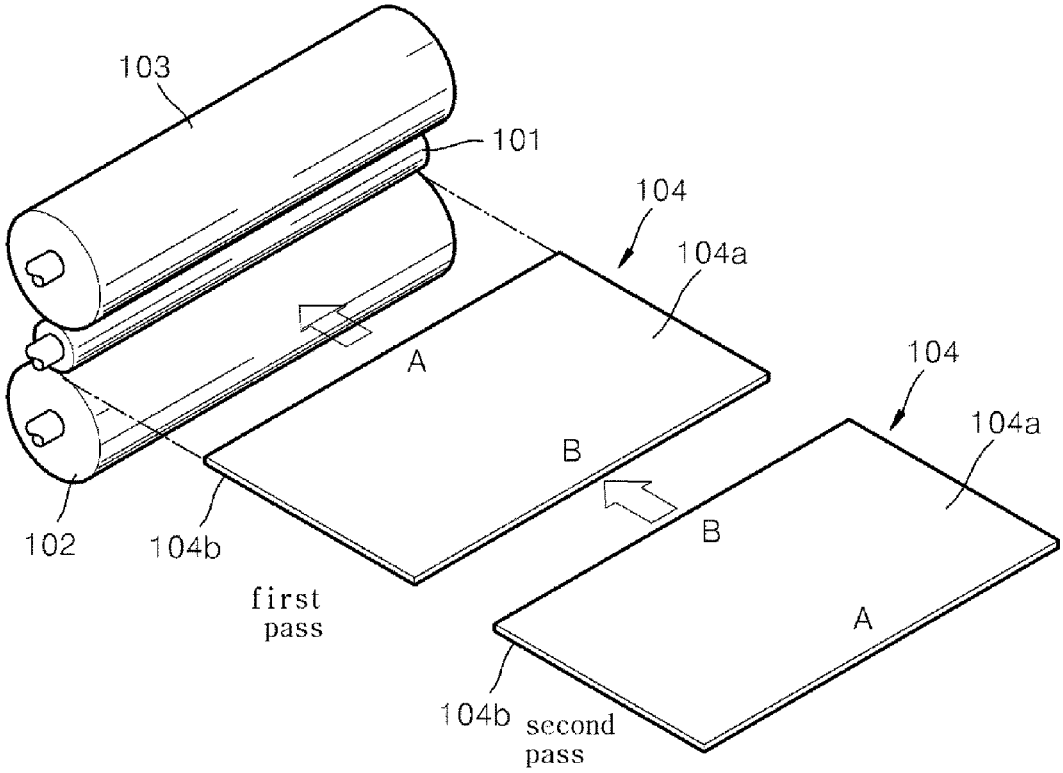
FIG. 13 is a diagram for describing a rolling method according to another embodiment of the present invention.

For example, as illustrated in FIG. 13, a rolling direction of the rolling material 104 is set in such a way that the rolling material 104 is inserted between the first and second rolls 101 and 102 in direction A in a first pass. In a second pass, the rolling direction of the rolling material 104 is turned by 180° so that the rolling direction is direction B while the first and second surfaces 104*a* and 104*b* are in the same orientation as the first pass.

Figure 14:
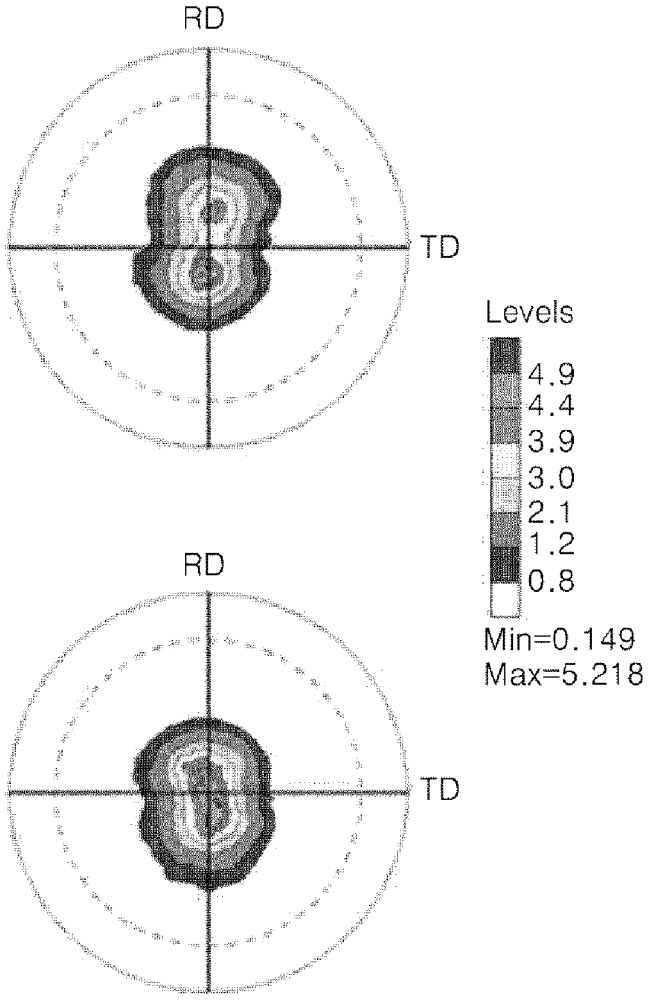
FIG. 14 shows the (0001) pole figures of an AZ31 alloy rolled by using the rolling method illustrated in FIG. 13.

FIG. 14 shows the (0001) pole figures of an AZ31 alloy rolled at a rolling temperature of 300° C. in a total of five passes while changing rolling directions between each pass (a rolling reduction ratio was 75%). In FIG. 14, a lower figure is the (0001) pole figure of the first surface 104*a* that received a shear strain from the first roll 101, and an upper figure is the (0001) pole figure of the second surface 104*b* that received a shear strain from the second roll 102. As illustrated in FIG. 14, a rotation angle on the first surface 104*a* that received a shear strain from the first roll 101 was about 5°, and a rotation angle on the second surface 104*b* that received a shear strain from the second roll 102 was about 17°. The rotation angles are greater than those of the (0001) pole figures illustrated in FIGS. 8 through 10.

In addition to reinserting a rolling material after being physically released from working rolls of a rolling apparatus as illustrated in FIG. 13, embodiments of a method of performing rolling a plurality of times by changing rolling directions include reinserting the rolling material between the working rolls by allowing the working rolls to rotate in reverse while the rolling material is still disposed between the working rolls.

In addition to Mg or an Mg alloy, the above-described rolling apparatuses and rolling methods may be applied to any material for controlling texture of a rolled material. For example, a metallic material containing titanium (Ti) or a Ti alloy and having a HCP crystal structure, a metallic material containing Al or an Al alloy, or an iron-silicon (Fe—Si) alloy having magnetic properties influenced by an orientation of crystals of a rolled material may be used as a rolling material.

While the present invention has been particularly shown and described with reference to exemplary embodiments thereof, it will be understood by one of ordinary skill in the art that various changes in form and details may be made therein without departing from the spirit and scope of the present invention as defined by the following claims.

The invention claimed is:

1. An asymmetric rolling method comprising:

disposing a rolling material having first and second surfaces between a first roll and a second roll having a diameter greater than that of the first roll, the rolling material having a crystal structure that includes a primary axis and a basal plane perpendicular to the primary axis;

adjusting power provided to first and second rolls using a power providing unit to control linear velocities of the first and second rolls to be the same such that a shear strain applied by the first roll to a first surface of a material rolled therebetween is greater than a shear strain applied by the second roll to a second surface of the material rolled therebetween; and rolling the rolling material between the first and second rolls, wherein in the rolling the rolling material, an orientation of the crystal is arranged to improve formability by controlling texture of a rolled material, and wherein in the rolling the rolling material, the basal plane slip system of the rolling material is tilted by an angle greater than 0 degrees and smaller than 90 degrees with respect to a rolling direction.

2. The asymmetric rolling method of claim 1, wherein the rolling material is rolled two or more times by applying a first shear strain to the first surface with the first roll and applying a second shear strain to the second surface with the second roll.

3. The asymmetric rolling method of claim 1, further comprising:

inverting orientation of the first and second surfaces of the rolling material after the step of rolling the rolling material between the first and second rolls; and rolling the rolling material in the inverted orientation.

4. The asymmetric rolling method of claim 1, wherein the rolling material is rolled two or more times in the same rolling direction.

5. The asymmetric rolling method of claim 1, further comprising:

changing a rolling direction of the rolling material after the step of rolling the rolling material between the first and second rolls; and rolling the rolling material in the changed rolling direction.

6. The asymmetric rolling method of claim 1, wherein, after the rolling the rolling material, the rolling material has a minimum rotation angle of a pole point of the basal plane from a center of a pole point of 6°.

7. The asymmetric rolling method of claim 1, wherein the rolling material is an AZ31 alloy.

8. The asymmetric rolling method of claim 7, wherein a rolling reduction ratio of the rolling material is 75%.

9. The asymmetric rolling method of claim 1, wherein the rolling material has a hexagonal closely-packed (HCP) crystal structure.

10. An asymmetric rolling method comprising:

placing a rolling material having first and second surfaces between a first roll and a second roll having a diameter greater than that of the first roll, the rolling material having a crystal structure that includes a primary axis and a basal plane perpendicular to the primary axis;

coupling a third roll having a diameter greater than that of the first roll to the first roll to support the first roll on a side opposite to the second roll;

adjusting power provided from a power unit to each of the second and third rolls to control linear velocities of the first roll and the second roll to be the same such that a shear strain applied by the first roll to a first surface of a material rolled therebetween is greater than a shear strain applied by the second roll to a second surface of the material rolled therebetween; and rolling the rolling material between the first and second rolls, wherein in the rolling the rolling material, an orientation of the crystal is arranged to improve formability by controlling texture of a rolled material, and wherein in the rolling the rolling material, the basal plane slip system of the rolling material is tilted by an angle greater than 0 degrees and smaller than 90 degrees with respect to a rolling direction.

11. An asymmetric rolling method for rolling a rolling material by using at least one pair of working rolls, the method comprising:

rolling a first roll with a first diameter and a second roll with a second diameter larger than the first diameter at the same linear velocity using power provided by a power providing unit, wherein the rolling material has a crystal structure that includes a primary axis and a basal plane perpendicular to the primary axis, wherein in the rolling the rolling material, an orientation of the crystal is arranged to improve formability by controlling texture of a rolled material, and wherein in the rolling the rolling material, the basal plane slip system of the rolling material is tilted by an angle greater than 0 degrees and smaller than 90 degrees with respect to a rolling direction.

12. The asymmetric rolling method of claim 11, wherein the rolling material is rolled a plurality of times, and wherein a first side of the rolling material contacts the first roll in a first rolling pass, and the first side of the rolling material contacts the second roll in a second rolling pass.

13. The asymmetric rolling method of claim 11, further comprising:

rolling the rolling material a first time in a first direction; and rolling the rolling material a second time in a second direction different from the first direction.

14. The asymmetric rolling method of claim 11 further comprising transmitting a force from a backup roll to the first roll.

* * * * *